US005328388A

United States Patent [19]

Fust et al.

[11] Patent Number: 5,328,388

[45] Date of Patent: Jul. 12, 1994

[54] MODULAR ELECTRICAL CONNECTOR

[75] Inventors: Robert E. Fust, Milford; Seiji Kozono, Farmington Hills, both of Mich.

[73] Assignee: Yazaki Corporation, Tokyo, Japan

[21] Appl. No.: 69,972

[22] Filed: May 28, 1993

[51] Int. Cl.[5] ..... H01R 13/74

[52] U.S. Cl. ..... 439/544; 439/364; 439/540; 439/571

[58] Field of Search ..... 439/359, 362, 364, 540, 439/544, 550, 552, 555, 556, 562, 563, 571, 573

[56] References Cited

U.S. PATENT DOCUMENTS 3,753,212 8/1973 Yamada et al. .
5,139,431 8/1992 Saitoh et al. .

FOREIGN PATENT DOCUMENTS 1590478 6/1981 United Kingdom ..... 439/559

*Primary Examiner*—Eugene F. Desmond
*Attorney, Agent, or Firm*—Krass & Young

[57] ABSTRACT

A modular connector for establishing multiple electrical connections through an opening in a vehicle body panel. A frame member, having opposite sides and mountable to the panel opening, has a means for sealing the body panel opening. The frame member has a plurality of connector module apertures. A cover, which is securable to one side of the frame member, has a plurality of connector module receptacles which correspond to and align with the connector module apertures. One or more female connector modules, each providing multiple terminals, mount in a receptacle in the cover and align with a frame opening. One or more male connector modules, each providing multiple terminals, aligns with a frame opening and mating to a corresponding female connector module. A means is provided for securing the female connector module to the male connector module.

20 Claims, 8 Drawing Sheets

12
20
16
23
26
23
31
30
34
22
30
24
22
26
11
30
24
18
32
A
36
51
51
32
14
32
32
51
10a
42
10
17
28
52
B
28
54
54
15
28
66
54
66
66
72
72
C
58
64
72
58
56
62
40
57

FIG-4
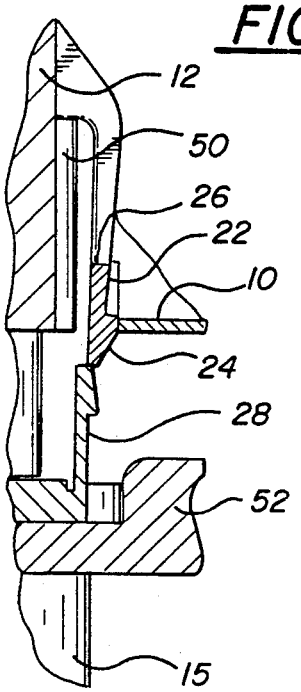
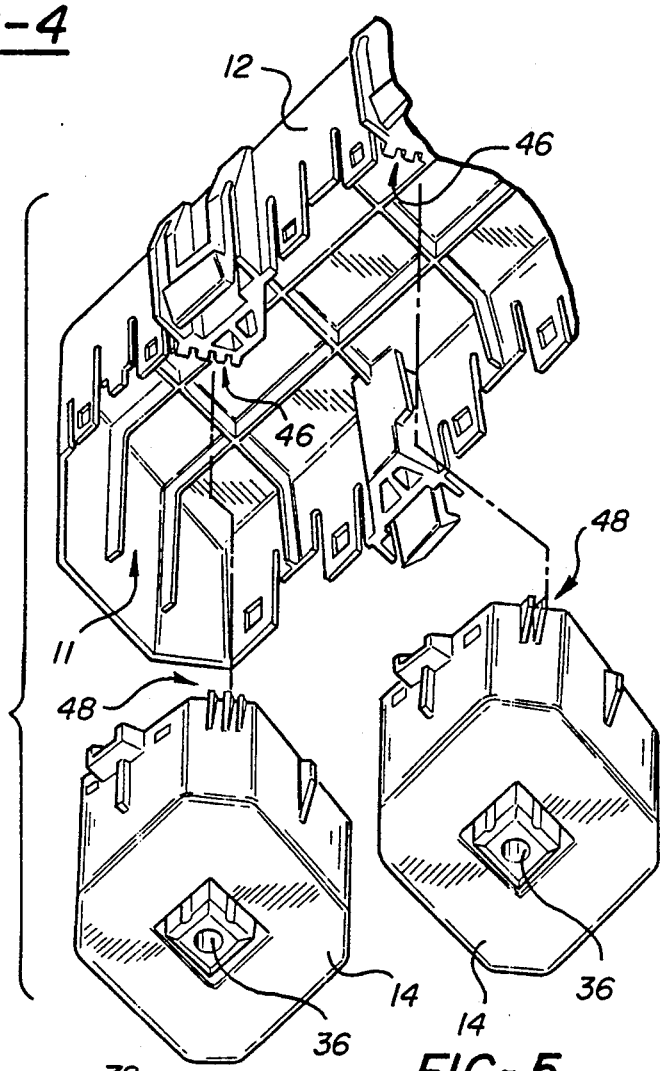
FIG-5
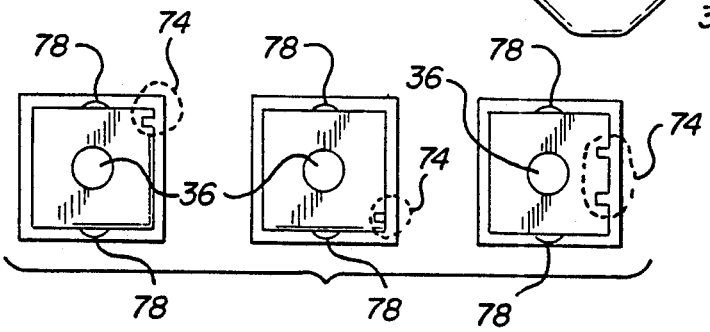
FIG-6A
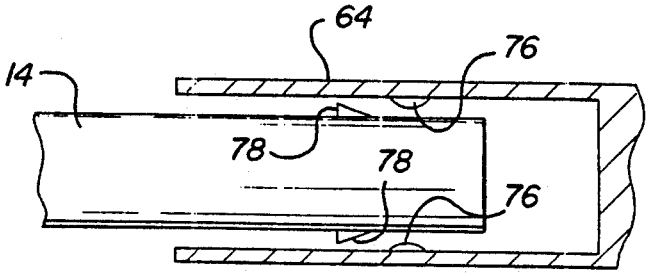
FIG-6B

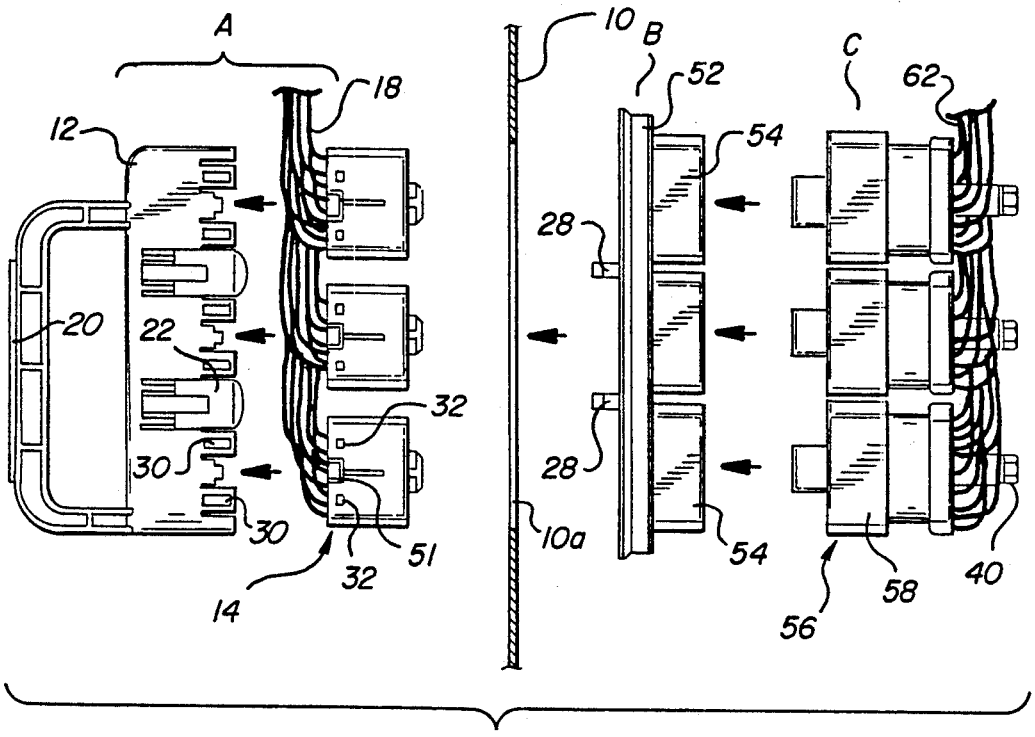
FIG-7
FIG-8A
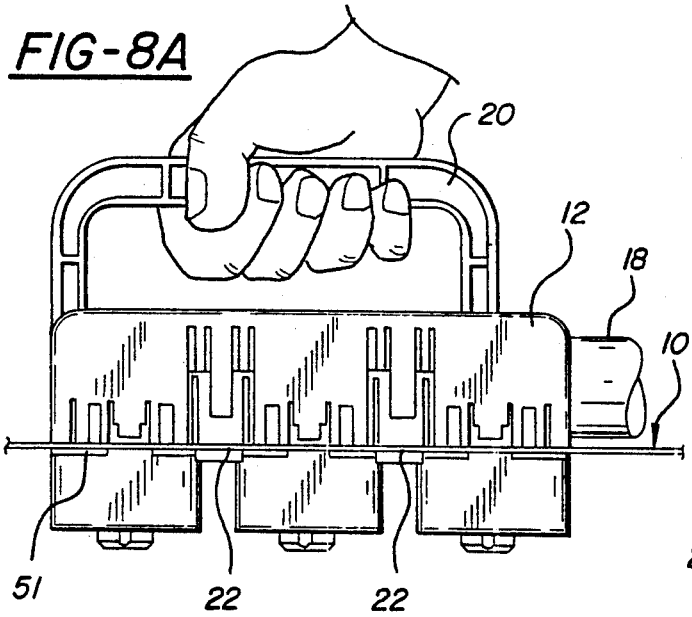
FIG-8B
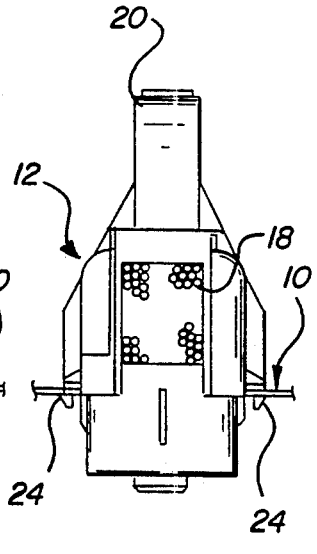

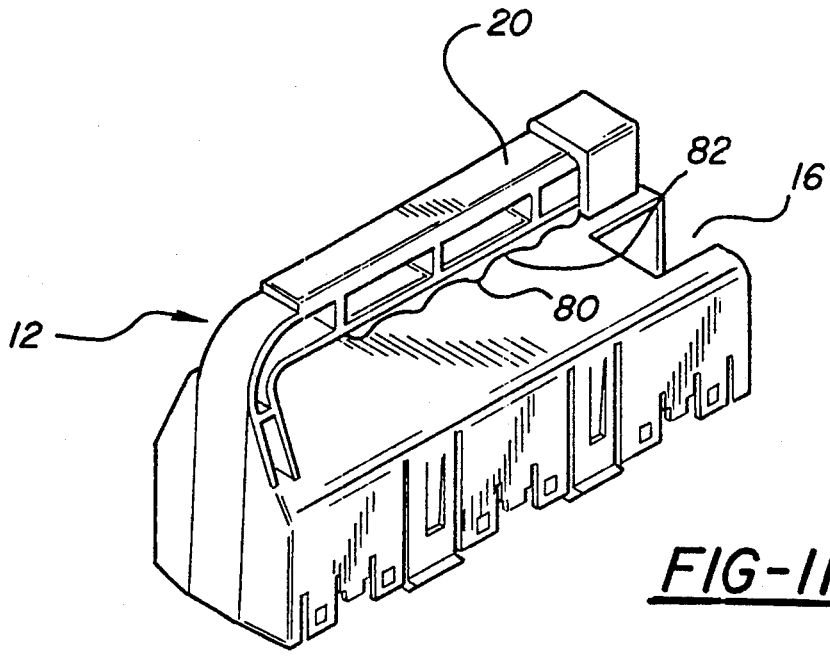
FIG-11
FIG-12
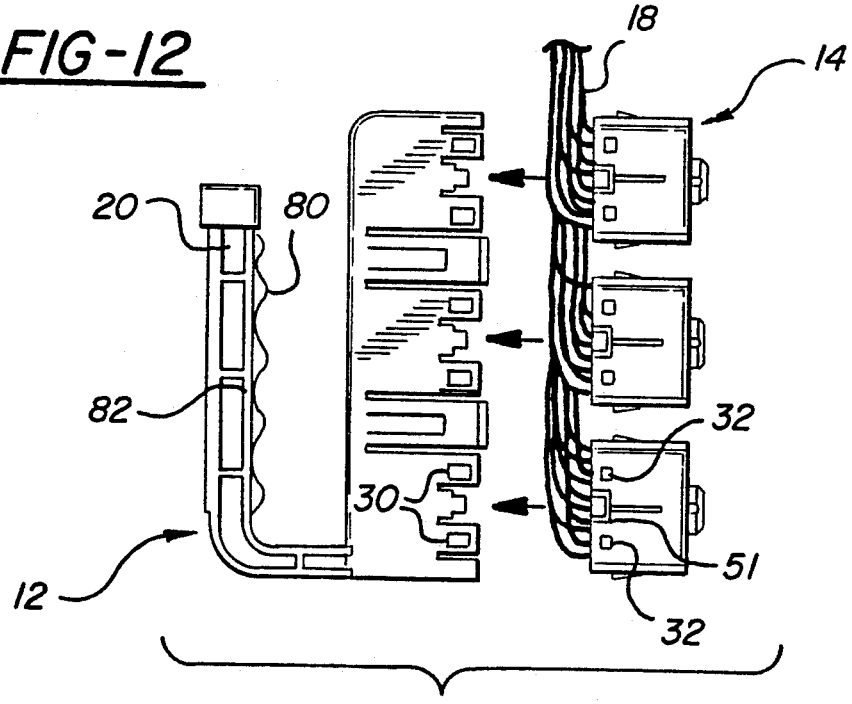

MODULAR ELECTRICAL CONNECTOR

FIELD OF THE INVENTION

This invention relates to a modular electrical connector and more particularly to a modular electrical connector for connecting wires between opposite sides of a body panel in a vehicle.

BACKGROUND OF THE INVENTION

FIGS. 13 and 14 show prior art connectors which interconnect wires through a panel opening. FIG. 13 shows an assembly of connectors a which are connected to the terminals of a wire harness w1. The connectors are covered by a flange d which is fitted with a waterproof grommet f. The grommet f has a seal e which prevents water drops from passing through the panel opening. The connector mounts to the engine side of the panel b. A plurality of connectors c1 and c2 connect on the passenger side of the panel b and form an interior wiring harness w2.

FIG. 14 shows an interior connector assembly i and another connector assembly a which is located on the engine side of the panel. A grommet on connector assembly a seals the panel opening. Sealing is assisted through the use of a bolt and nut which presses the connector assemblies against the panel.

Previous connectors which connect wires through an automobile body panel have lacked flexibility as to the number of connections available. One approach taken by prior art connectors is to make a single connector large enough to accommodate the maximum number of connections which would possibly be required. Since these connectors are designed with a maximum number of connections, very few installations will effectively utilize the connector. For example, if the maximum number of connections required is 120, but only 50 connections are used in a particular vehicle, more than half of the connector is wasted. A large number of unused connections wastes space in the vehicle body panel, requires connector terminals and hardware which is never used, and generally costs more to manufacture.

Another approach taken by prior art connectors is to use a smaller connector which is large enough to accommodate the connection requirements of an average vehicle. Since these connectors are only designed for the average vehicle, many applications will require more connections than the connector provides. In this situation, either a second connector must be used to accommodate the additional connections required, or a new connector must be designed. Designing a new connector for a single vehicle application is an expensive and time-consuming solution. Furthermore, additional connector designs require a manufacturer to keep many different connectors in stock and may cause confusion among assemblers as to which connector to install in a particular vehicle.

The use of a second connector also requires that an additional hole be created in the vehicle body panel. Often, it may be difficult to find adequate space for an additional hole without moving or redesigning other components on or near the body panel. Also, if the additional hole is placed too close to the original hole, weakness problems can develop due to the thin ribbon of panel material remaining between the connectors. The use of a second connector also requires the use of an additional sealing gasket to seal the opening between the connector and the panel.

Perhaps most importantly, the addition of a second connector complete with internal and external conductive terminals may add a cost factor which is disproportionate to the added utility; e.g., the addition of a 60-terminal connector to accommodate perhaps 10 new circuits is cost-inefficient.

Prior art connectors have included a bolt in one connector which interacts with a nut in the mating connector. However, prior art connectors have used a press-fit insert as the nut. These press-fit inserts tend to break loose from the connector and are likely to mis-thread. Disruptions in the assembly process result when the bolt cannot be properly tightened.

SUMMARY OF THE INVENTION

The present invention provides a modular electrical connector which solves the above mentioned problems. Through the use of the inventive modular connector, a given connector covering structure can be fitted with one, two, three or more connector modules, each of which is capable of accommodating "x" circuits. If "x" or fewer circuits are used in the vehicle, the spaces within the cover for connector modules two and three are simply blocked off. If the number of circuits is more than "x" but less than "2x", two modules are installed, and so on. This modular approach fixes the cover size, fixes the panel hole size and "standardizes" the sealing gasket.

In an illustrative arrangement, the invention allows for connection of up to 120 wires through a single panel opening. Individual connector modules in a three-module design can accommodate up to 40 wires. Thus, if up to 40 wires are required, only one connector module is used and the spaces for modules two and three are blocked off. The single module reduces costs by not using a large amount of unnecessary connector hardware. If, in a future application, additional wires are needed, another connector module can be added without changing the existing hole, gasket, or component placement.

A further objective of the present invention is to provide a connector assembly which is easily grasped and manipulated, even when a large number of wires are present. A handle may be used to assist with grasping and manipulating the connector assembly.

Another objective of this invention is to provide a detent system which temporarily secures the connectors together, preventing separation before final connection.

Another objective of the present invention is to provide a nut which is molded into a connector module. The nut, being molded-in, is less likely to break loose from the connector module or mis-thread.

Thus, the present invention provides a modular electrical connector system which is flexible, economical and allows for a large number of connections through a small panel opening.

The embodiment of the invention illustrated herein is a modular electrical connector for use in an automotive vehicle for making multiple electrical connections from the engine compartment through the firewall to the passenger compartment. Female connector modules mount to a cover, which in turn mounts to the passenger compartment side of a vehicle body panel opening. A standardized frame member capable of accommodating several modules, but requiring only one, is mounted to the engine compartment side of the vehicle body panel opening. A single gasket is located between the frame and the body panel, thereby sealing the vehicle body panel opening. Male connector modules mount to the female connector modules through the frame. Unused frame openings, if any, are capped. A bolt in one connector module interacts with a molded-in nut in the mating connector module to secure the connectors together and urge the gasket against the panel.

The cover and the female connector modules are keyed to ensure proper connector location and orientation within the cover. Also, a detent system is provided which temporarily secures the male connector modules to the female connector modules until the bolt is tightened.

The cover is preferably provided with an integral handle to facilitate manipulation of the connector assembly. Alternatively, the cover may have an unobstructed surface to grasp and push against. An opening in either end of the cover is provided for routing a wire harness.

BRIEF DESCRIPTION OF THE DRAWINGS

For a more complete understanding of the invention, reference should be made to accompanying drawings, in which:

FIG. 4 is a view showing the frame locking projection and the resilient detent arm when the cover is not properly mounted;

FIG. 5 is an exploded perspective view showing the female connector module key protrusions on two of the connector modules and their interaction with the cover key indentation;

FIG. 6*a* is an enlarged view of the female connector module looking along the axis of the central through hole, showing the female connector module key indentations and female connector module detent projections;

FIG. 6*b* is an enlarged detail view showing the interaction of the bolt tower detent projections with the female connector module detent projections;

FIG. 7 is an exploded view looking along the panel axis showing how the modular electrical connector system is assembled;

FIG. 8*a* is an elevational view showing the side of an assembled modular electrical connector system;

FIG. 8*b* is an elevational view showing the end of an assembled modular electrical connector system;

FIG. 11 is a perspective view showing a second embodiment of the cover;

FIG. 12 is a side elevational view of the second cover embodiment;

DETAILED DESCRIPTION OF THE PREFERRED EMBODIMENT

Figure 1:
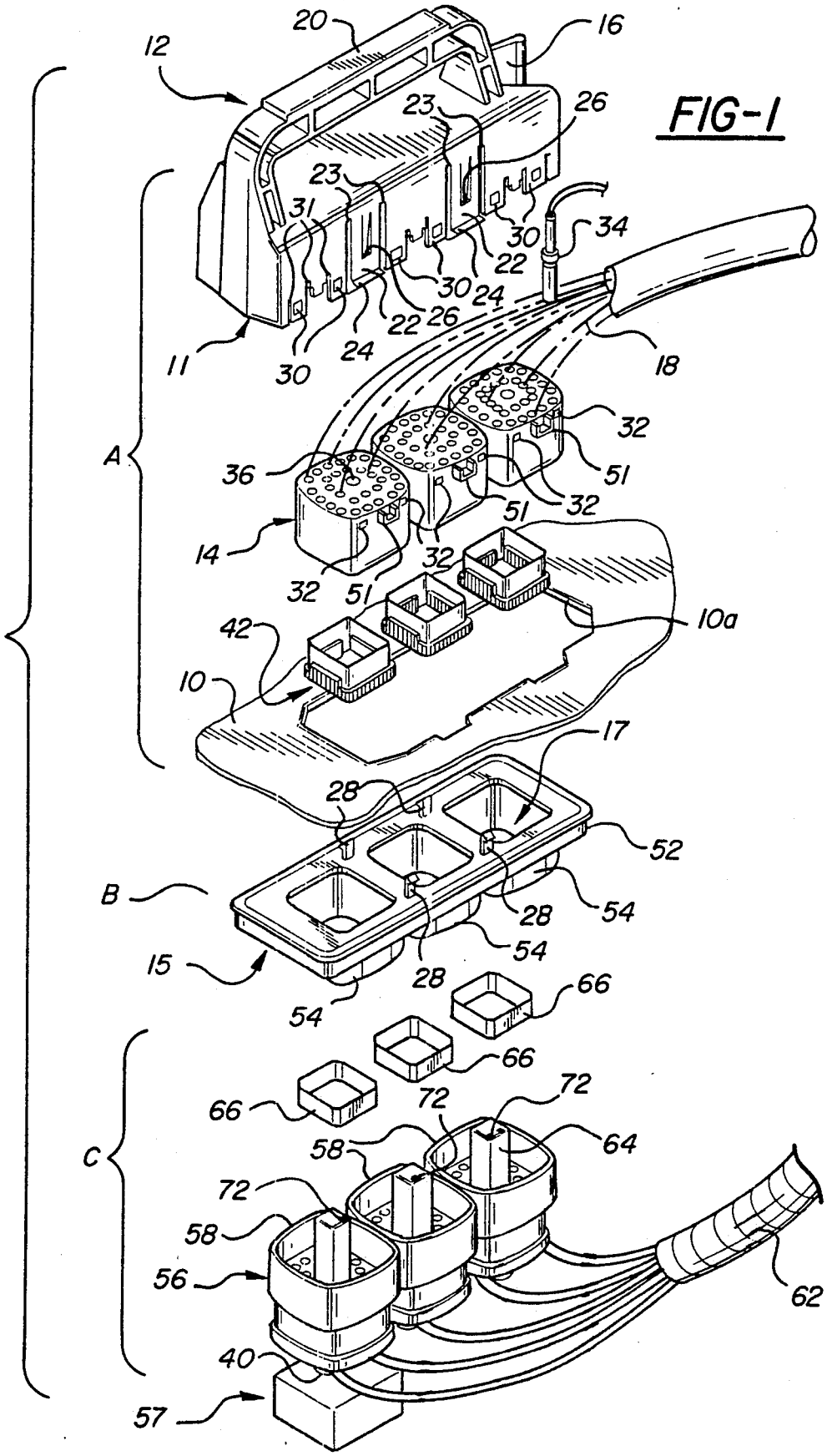
FIG. 1 is an exploded perspective view of a modular electrical connector system according to one embodiment of this invention.

FIG. 1 illustrates a three-module connector comprising a female connector assembly A mountable on one side of a vehicular body panel 10 having a pre-formed opening 10*a* therein. A plastic frame 15 mounts to the engine side of the opening 10*a* in panel 10. Male connector assembly C mates with the connectors in the female connector assembly A.

Female connector assembly A includes a molded plastic connector cover 12 which receives a molded plastic female connector module 14. Cover 12 has an opening 16 for routing a wire harness 18. The opening 16 may be located at either end of cover 12, depending on the particular needs of the vehicle wiring system. A handle 20 is molded integrally with cover 12, allowing female connector assembly A to be easily grasped and manipulated. Cover 12 includes a series of receptacles 11 for receiving female connector modules 14.

Cover 12 has four integral resilient detent arms 22. Two detent arms 22 are located on each of the two longer sides of cover 12. Detent arms 22 are defined by slots 23 in cover 12, and can thus flex inwardly and outwardly independently of cover 12. A locking projection 24 is located at the free end of each detent arm 22. Detent arm 22 also has a locking engagement 26 which receives a frame locking projection 28. Locking engagement 26 is defined by an edge of the opening in detent arm 22.

Cover 12 also has engagement tabs 30, four for each of the three female connector modules 14. Engagement tab 30 is defined by slots 31 in cover 12. Engagement tab 30 receives an engagement projection 32 located on female connector module 14.

Figure 2:
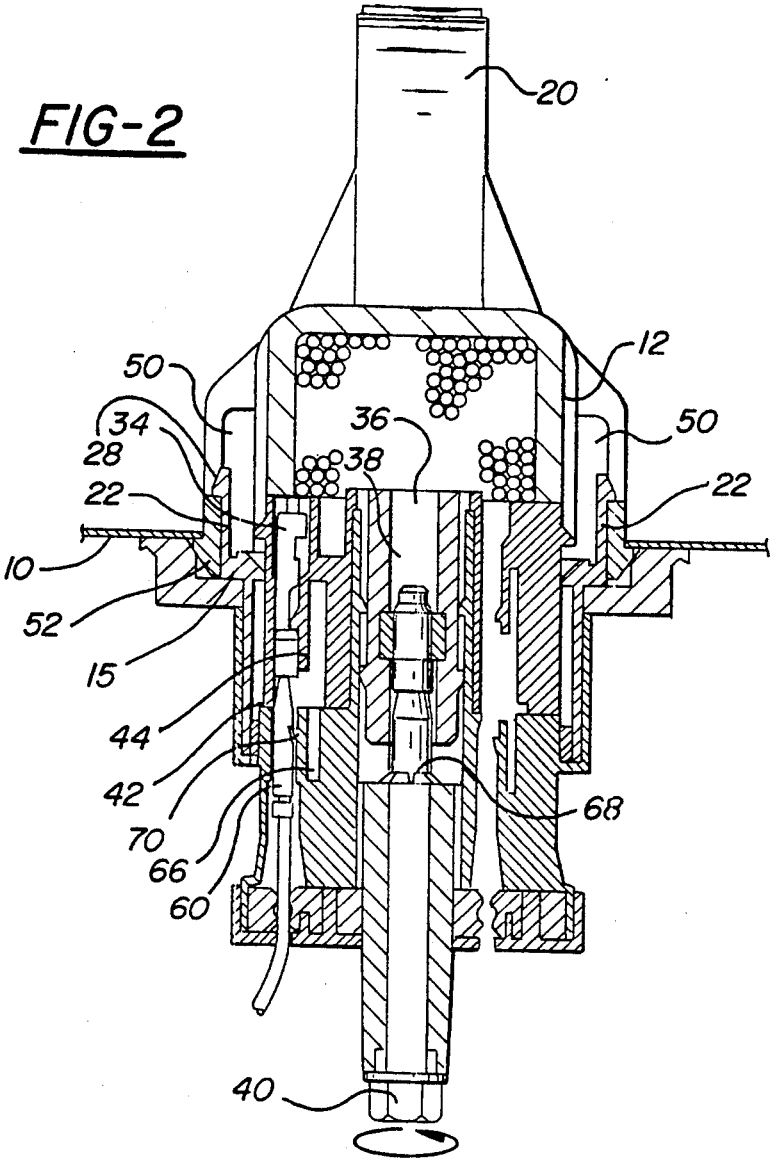
FIG. 2 is a cross sectional view showing a fully connected modular electrical connector system.

As shown in FIG. 1, female connector module 14 contains a plurality of terminals 34 which connect to wires and form a wire harness 18. Each female connector module 14 also has a central through hole 36. As shown in FIG. 2, a steel nut 38 is insert molded into through hole 36. Nut 38 receives a metal bolt 40 from the male connector assembly C.

Female connector module 14 further contains a plastic spacer 42 which is inserted between terminals 34. As shown in FIG. 2, spacer 42 locks terminals 34 in position by pressing a resilient lever 44 against terminal 34. Spacer 42 also aligns terminals 34 to mate properly with the corresponding male connector assembly C. As shown in FIG. 5, cover 12 has three different sets of cover key indentations 46. A first set of cover key indentations 46 has one indentation, a second set has two indentations, and so on. Indentations 46 interact with three different sets of female connector key protrusions 48; the first set having one protrusion, the second set having two protrusions, and so on. Since each indentation/protrusion combination is unique, it is not possible to insert female connector module 14 into an incorrect receptacle 11 in cover 12. Also, the indentation/protrusion interaction prevents female connector module 14 from being rotated to the wrong position in cover 12.

Referring to FIG. 1, when the correct female connector module 14 is properly aligned with the correct receptacle 11 in cover 12, module 14 is permitted to slide into cover 12. When module 14 is fully inserted, engagement projections 32 on module 14 align with engagement tabs 30 on cover 12. This alignment locks the female connector module 14 into cover 12.

Referring to FIG. 1, frame 15 has a sealing gasket 52 around the perimeter of the frame surface which contacts panel 10. Sealing gasket 52 is made from a foam or rubber material and provides a seal to prevent moisture or gases from flowing through panel opening 10*a*. Frame 15 also has three hoods 54, one for each of up to three female connector modules 14. Hood 54 defines an aperture 17 in frame 15. Aperture 17 provides an opening in frame 15 through which connector modules mount. Hood 54 functions to align the male connector assembly C when it is inserted into the mating female connector assembly A. Four frame locking projections 28 extend from frame 15 on the same side as sealing gasket 52.

Referring to FIG. 1, a molded plastic male connector module 56 is shown. A skirt 58 is located around the perimeter of male connector module 56 on the side which contacts female connector module 14. Skirt 58 is of such dimension that it slides inside frame hood 54, creating a close-fitting contact. Male connector module 56 also contains a plurality of terminals 60 which connect with wires to form a wiring harness 62. A plastic male wire routing shield 57 covers the wire end of male connector module 56. Male wire routing shield 57 permits wires to leave any one side of male connector module 56. Each male wire routing shield 57 can be oriented in a different direction, allowing wires to be routed in the most effective manner. A bolt tower 64 extends upwardly from the contact side of male connector module 56. Bolt tower 64 aligns and guides male connector module 56 when inserted into female connector module 14. Bolt 40 extends up into the center of bolt tower 64. The head of bolt 40 is located at the wire side of male connector module 56, allowing access for final tightening. A spacer 66 is inserted between terminals 60 in male connector module 56. Spacer 66 locks terminals 60 in place by pressing a resilient lever 70 (shown in FIG. 2) against terminals 60. Further, spacer 66 aligns terminals 60 to mate properly with the corresponding female connector assembly A.

As best shown in FIG. 2, bolt 40 is retained in male connector module 56 with a steel bolt retainer 68. Bolt retainer 68 prevents bolt 40 from falling out of male connector module 56 before bolt 40 is tightened to nut 38.

This modular electrical connector system also has a detent feature which prevents separation of male connector module 56 from female connector module 14 before bolt 40 is tightened to nut 38. Referring to FIG. 6*b*, the detent feature includes detent projections 76 located on opposite inner sides of bolt tower 64. As bolt tower 64 slides into female connector module 14, bolt tower detent projections 76 contact female connector detent projections 78. As male connector module 56 is further pushed, bolt tower detent projection 76 slides past female connector detent projection 78. At this point, the detent feature prevents separation of male connector module 56 from female connector module 14. Therefore, it is not necessary to immediately tighten bolt 40. Instead, additional vehicle production steps may be performed without risk of connector separation.

To assemble the inventive modular electrical connector system, spacer 42 is first inserted into female connector module 14. Next, female connector module 14 is mounted to cover 12. Engagement tab 30 on cover 12 operatively interacts with engagement projection 32 on female connector module 14 to lock module 14 into cover 12.

Next, the female connector assembly A is mounted to automobile body panel 10. Referring to FIG. 4, as the assembly is moved toward panel 10, locking projection 24 of detent arm 22 first contacts panel 10. As the assembly is pushed closer to panel 10, detent arm 22 is pushed into a space 50 located under detent arm 22. When the assembly is fully inserted into panel opening 10*a*, locking projection 24 passes panel opening 10*a* and detent arm 22 returns to its original position. A stopper 51 (shown in FIG. 1) comes in contact with panel 10 and prevents the female connector assembly from pushing through panel opening 10*a*.

Figure 3:
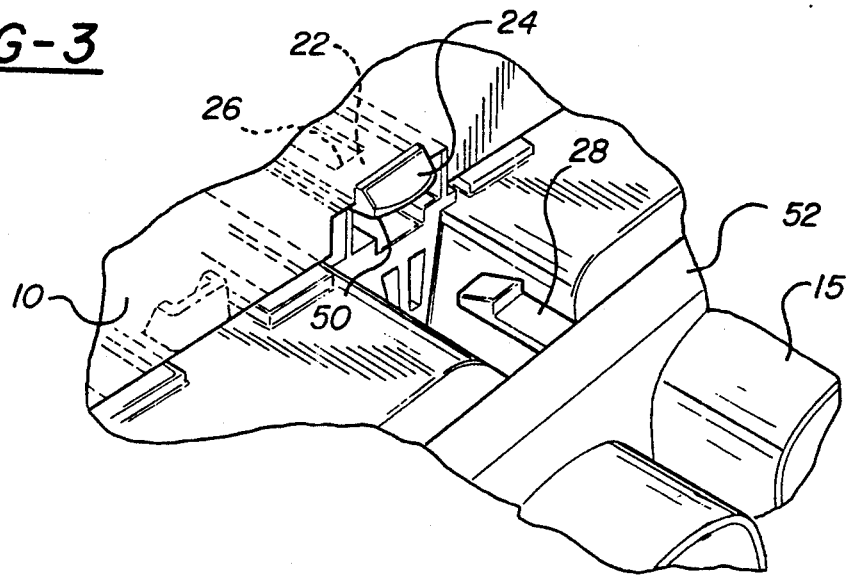
FIG. 3 is a partially broken perspective view showing the frame locking projection and the resilient detent arm just before engagement.

Referring to FIG. 3, frame 15 is shown just before contact with panel 10. As frame 15 is pushed toward panel 10, locking projection 28 on frame 15 contacts the end of detent arm 22. As frame 15 is further pushed toward panel 10, locking projection 28 is pushed down and under detent arm 22 and into space 50 below the detent arm. When frame 15 is further pushed, locking projection 28 on frame 15 aligns with locking engagement 26 on cover 12 and locking projection 28 returns to its original position. At this point, frame 15 is locked to panel 10 due to the interaction of locking projection 28 and locking engagement 26.

As best shown in FIG. 4, frame 15 cannot be mounted to panel 10 unless cover 12 is properly and fully inserted into panel opening 10*a*. If cover 12 is not properly mounted, detent arm 22 will still be present in the space 50. If detent arm 22 is occupying space 50, then frame locking projection 28 cannot enter space 50. Thus, unless cover 12 is properly mounted, frame 15 cannot be mounted to panel 10.

The next assembly step is to insert the male connector assembly C into the already mounted female connector assembly A. As shown in FIG. 1, bolt tower 64 has a key protrusion 72 which extends inwardly from the inner surface of bolt tower 64. As shown in FIG. 6*a*, a corresponding key indentation 74 is located in each female connector module 14. Each protrusion/indentation combination is unique. Thus, it is impossible to insert a male connector module 56 into the wrong female connector module 14 or rotated in the wrong position.

The final assembly step is to tighten bolt 40 to nut 38. As bolt 40 is tightened, male connector module 56 is securely mounted to female connector module 14. Also, as bolt 40 is tightened, sealing gasket 52 is urged against panel 10, forming a tight seal. This seal prevents moisture or gases from passing through panel opening 10*a*. A male wire routing shield 57 slides over the wire end of male connector module 56, directing the wires to the wiring harness 62. FIG. 7 provides another view showing how the various connector components are interconnected. FIGS. 8*a* and 8*b* show the modular electrical connector system after assembly is completed.

Figure 9A:
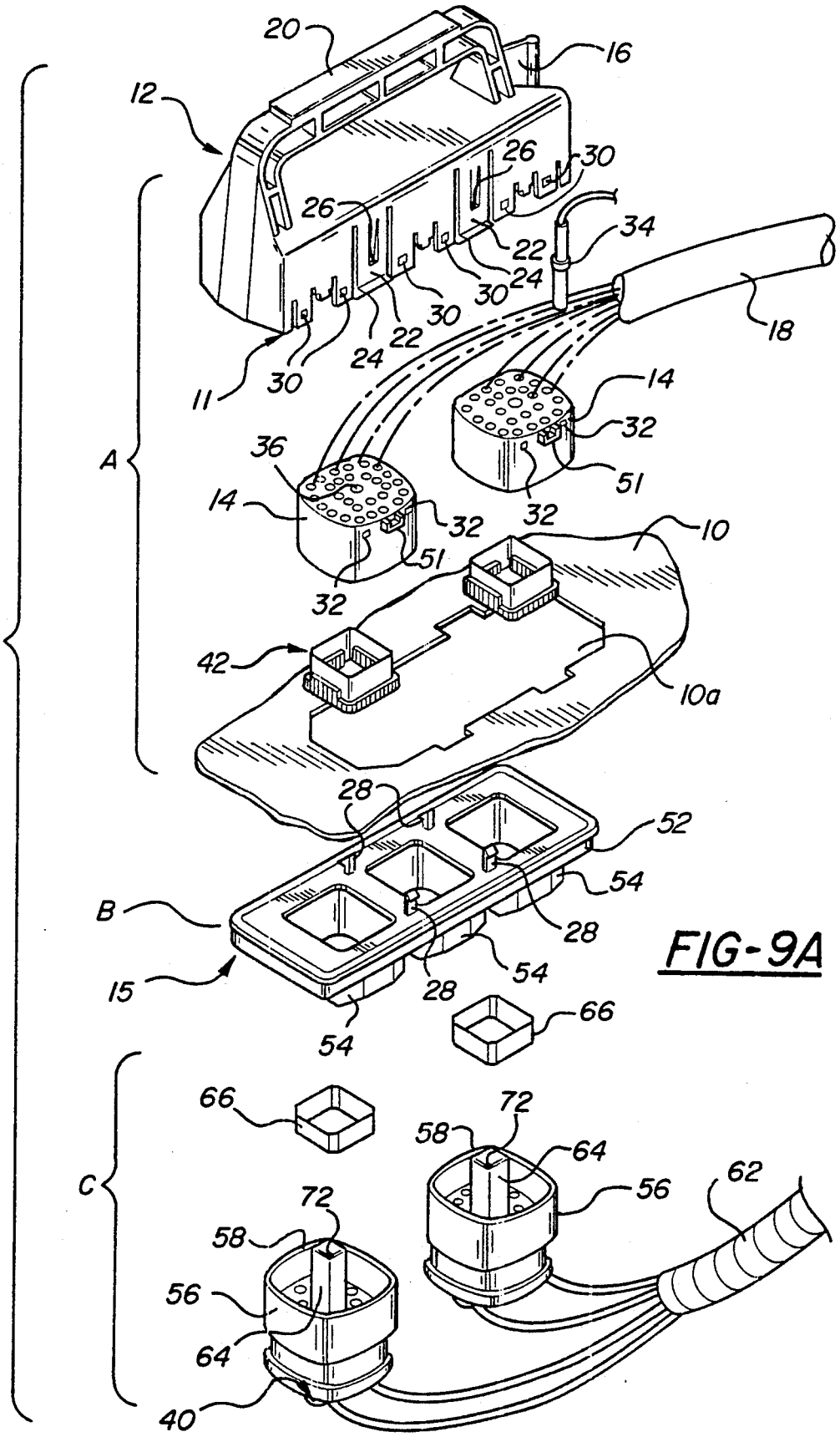
FIG. 9*a* is an exploded perspective view of the modular electrical connector system in which only two connector modules are used.
Figure 10:
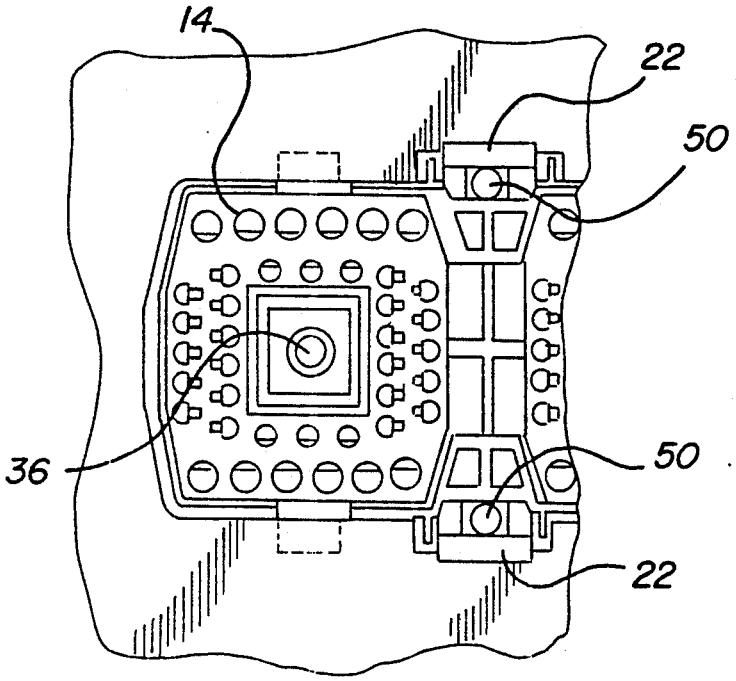
FIG. 10 is a detail view of the cover with a female connector module inserted, looking along the axis of the central through hole.
Figure 9B:
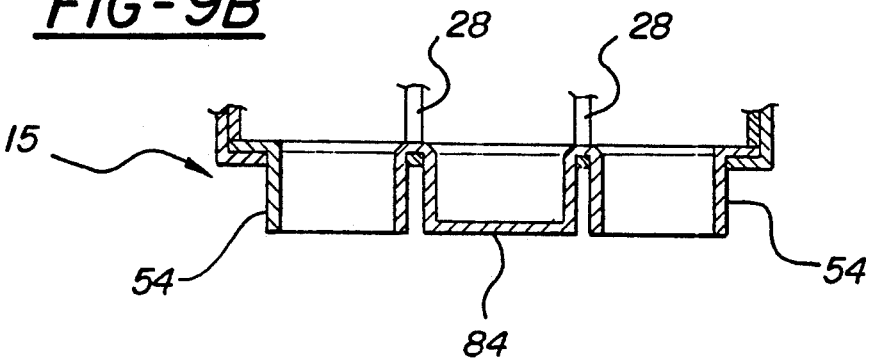
FIG. 9*b* is a view of the frame shown in FIG. 9*a*, along the line X—X.
Figure 13:
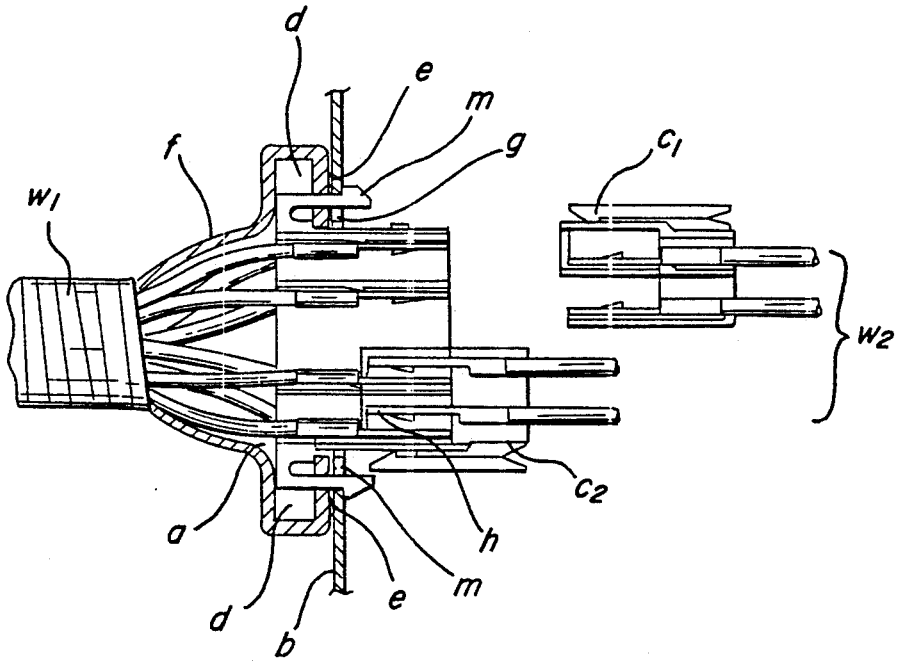
FIG-13 (PRIOR ART)
FIG. 13 is a sectional view of a prior art multi-terminal connector assembly.
Figure 14:
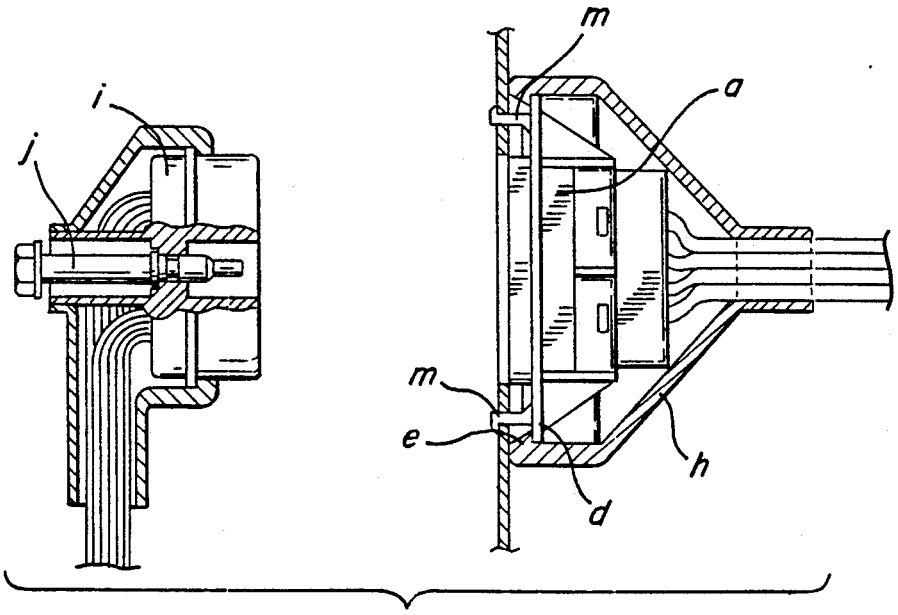
FIG-14 (PRIOR ART)
FIG. 14 is a sectional view of a prior art screw-tightened connector assembly.

Referring to FIG. 9*a*, the present invention is shown with only two connector modules installed. The connector system uses the same method of assembly and the same components, with one exception. As best shown in FIG. 9*b*, the unused opening in frame 15 is molded closed. Thus, different frames 15 are used to seal various frame openings. Alternatively, a cap 84 is inserted into the unused frame opening, thus sealing the opening. By using cap 84, only one type of frame 15 is manufactured and openings are capped as required by the particular vehicle installation.

Referring to FIGS. 11 and 12, an alternate embodiment of connector cover 12 is shown. This embodiment of cover 12 includes a handle 20 which is integrally molded in the cover, with one of two ends free; i.e., attached to cover 12 at only one end. In this embodiment, handle 20 has finger grips created by a series of projections 80 and recessions 82. The finger grips assist with grasping and manipulating female connector assembly A.

We claim:

1. A modular connector for establishing multiple electrical circuit connections through an opening in a vehicle body panel comprising:

a frame member having opposite sides and mountable to the panel in surrounding and sealing relationship to said opening; said frame providing a plurality of connector module apertures;

a cover means securable to one side of said frame; said cover means providing a plurality of connector module receptacles corresponding to and registrable with said connector module apertures;

at least one female connector module providing multiple electrical circuit terminals therethrough and mountable in a receptacle of said cover to register with a frame opening;

at least one male connector module providing multiple electrical circuit terminals therethrough and registrable with a frame opening on the opposite side thereof from said female connector module; and a means for securing said female connector module to said male connector module.

2. The modular connector as claimed in claim 1, further including means for sealing the connector module apertures that do not receive a connector module.

3. The modular connector as claimed in claim 1, in which the securing means is a bolt in a connector module on one side of said frame which interacts with a nut in a connector module on the opposite side of said frame.

4. The modular connector as claimed in claim 3, in which the nut is molded into the connector module.

5. The modular connector as claimed in claim 1, in which said cover means includes a locking means which prevents the frame member from being mounted to the panel when said cover means is not properly mounted to the panel.

6. The modular connector as claimed in claim 1, in which the cover means includes at its inner walls a first keying means which interacts with said female connector module to ensure proper insertion of said female connector module into the cover means.

7. The modular connector as claimed in claim 6, in which the first keying means is comprised of projections on said female connector module which interact with corresponding indentations in the cover means.

8. The modular connector as claimed in claim 1, in which said female and male connector modules contain a second keying means which ensures proper orientation of said female connector module with said male connector module.

9. The modular connector as claimed in claim 8, in which the second keying means comprises projections on the male connector module which interact with corresponding indentations in the female connector module.

10. The modular connector as claimed in claim 1, in which the connector modules contain a detent means for temporarily securing the female and male connector modules together until the connector modules are permanently connected.

11. The modular connector as claimed in claim 10, in which the detent means is comprised of protrusions on each of the connector modules; the protrusion on the male connector module slidably interacting with the protrusion on the female connector module.

12. The modular connector as claimed in claim 1, in which the connector modules contain a spacing means which locks connector terminals in their proper location.

13. The modular connector as claimed in claim 12, in which the spacing means displaces a bendable member in the connector module to lock a terminal into the connector module.

14. A covering assembly for use with electrical connector modules to secure the assembly to a vehicle body panel opening comprising:

a cover means mountable to the body panel opening; said cover providing a plurality of connector module receptacles;

at least one connector module mountable in a receptacle of said cover;

said cover further comprising engageable members for securing said cover to said body panel opening; and said cover having a means for easily grasping and manipulating said cover.

15. The covering assembly as claimed in claim 14, in which the means for easily grasping and manipulating said cover comprises a handle integrally molded into said cover.

16. The covering assembly as claimed in claim 15, in which said handle extends substantially transversely to the fitting direction of said cover into the panel opening.

17. The covering assembly as claimed in claim 15, in which said handle is molded into said cover with one end free.

18. The covering assembly as claimed in claim 15, in which said handle further comprises integrally molded finger grips.

19. The covering assembly as claimed in claim 14, in which the means for easily grasping and manipulating said cover comprises an unobstructed surface to grasp and push against.

20. The covering assembly as claimed in claim 14, in which said cover means has at least one opening through which a wiring harness is routed.

* * * * *